United States Patent [19]

Knowlton et al.

[11] Patent Number: 4,569,390

[45] Date of Patent: Feb. 11, 1986

[54] RADIATOR ASSEMBLY

[76] Inventors: Bryce H. Knowlton, 2310 El Moreno St., La Crescenta, Calif. 91214; Anthony Ruscetta, 428 Canon de Paraiso La., La Canada, Calif. 91011

[21] Appl. No.: 623,362

[22] PCT Filed: Sep. 24, 1982

[86] PCT No.: PCT/US82/01329

§ 371 Date: May 21, 1984

§ 102(e) Date: May 21, 1984

[87] PCT Pub. No.: WO84/01208

PCT Pub. Date: Mar. 29, 1984

[51] Int. Cl.[4] ..... F28F 9/12

[52] U.S. Cl. ..... 165/149; 165/153; 165/76; 29/157.3 R

[58] Field of Search ..... 165/149, 151, 76, 153; 29/157.3 R

[56] References Cited

U.S. PATENT DOCUMENTS

| | | | |
|---|---|---|---|
| 3,113,615 | 12/1963 | Huggins | 165/149 |
| 3,246,691 | 4/1966 | La Porte et al. | 165/151 |
| 3,750,744 | 8/1973 | Bowas | 165/76 |
| 4,196,774 | 4/1980 | Hoffmann | 165/149 X |

FOREIGN PATENT DOCUMENTS

| | | | |
|---|---|---|---|
| 2120769 | 12/1983 | United Kingdom | 165/149 |

*Primary Examiner*—Albert W. Davis, Jr.
*Assistant Examiner*—Peggy A. Neils
*Attorney, Agent, or Firm*—Albert O. Cota

[57] ABSTRACT

An improved radiator assembly (10) that functions as a crossflow heat exchanger for use on liquid cooled engines. The assembly (10) uses fewer parts than conventional radiators and features a core assembly (11) comprised of a single vertical-row plurality of horizontally or vertically and alternately stacked radiator fins (11*a*) and radiator tubes (11*b*). With this core-stack design all the heat exchanging elements are located in a single frontal plane with the ram air applied normal to the plane. The radiator fin design also employs more fins-per-inch than conventional designs. Therefore, allowing a greater fin-to-tube contact which, in turn, provides a more effective heat transfer surface. The core stack is held under compression by inserting the ends of the radiator tubes (11*b*) into corresonding apertures located on the inward side of a cylindrical seamless outlet reservoir (10) and inlet reservoir (15). The reservoirs are held in place by inserting over their upper and lower sections a one-piece first support member (18) and a second support member (20) respectively.

2 Claims, 7 Drawing Figures

RADIATOR ASSEMBLY

TECHNICAL FIELD

This invention relates to improvements in the design and method of manufacturing heat exchangers and more particularly to automative heat exchangers that function as crossflow radiators.

BACKGROUND ART

A heat exchanger is a device which effects the transfer of heat from one fluid to another. There are several basic types of heat exchangers in use today—the type described and disclosed herein is of the crossflow type as is used in automobile radiators to cool the fluid circulating through the engine block of a liquid cooled engine. In the crossflow type of heat exchanger two fluids (in this case ambient ram air and heated liquid) flow along the heat transfer surface at right angles (normal) to each other, where the heated liquid may flow in either a horizontal or vertical direction. The fluid flow takes place in spaces separated by a wall and heat is exchanged by convection at and conduction through the wall.

Current radiator designs employ several structural and fluid carrying elements. Therefore, the radiator reliability, expressed as a mean-time-between-failure (MTBF), will increase in direct proportion to the number of elements used. The most common time-induced failure modes are fluid leaks. These leaks most often occur at pressure points around the interfacing joint of the filler neck with the tank and at the interface of the radiator tubes with the tank header. Additionally, the tank seams are also subject to leaks. Most state-of-the-art tanks are joined by either a butt seam or a drop-down groove seam.

Using large quantities of components also affects cost effectiveness in terms of radiator manufacturing and assembly/selling costs. Additionally, the increased bulk and weight of the radiator increases fuel consumption, and more space must be allocated in the engine compartment to mount the radiator.

A search of the prior art did not disclose any patents that directly read on the instant invention. However, the following U.S. patents are considered related:

| U.S. PAT. NO. | INVENTOR | ISSUE DATE |
|---|---|---|
| 3,246,691 | LaPorte, et al | 19 April 1966 |
| 3,310,868 | LaPorte, et al | 28 March 1967 |

The two LaPorte patents disclose a cellular-tubular type of automotive radiator where the components are so related structurally that the radiator may be integrated in a single baking or solder melting operation with a minimum of handling and jigging.

In the later LaPorte patent the manufacturing process is improved by devising a method pre-stressing the radiator including the core mass by the sidewalls of the radiator which are devised as springs to compress the core mass at a constant rate.

DISCLOSURE OF THE INVENTION

The Improved Radiator Assembly provides an improvement over current automobile radiators by having a design that uses fewer parts and incorporates an advanced-design radiator core assembly. By having fewer parts the radiator can be assembled faster, easier and with less cost and installation in an automobile is facilitated. The core assembly is of a crossflow configuration having all its heat transferring surface on one frontal plane with ram air applied normal to the plane. The core stack in the preferred embodiment, is comprised of a single vertical-row of horizontally and alternately stacked radiator fins and radiator tubes, where the fins are of a zig-zag design. In a second embodiment the radiator fins and radiator tubes are alternately stacked in a vertical direction rather than in a horizontal direction. The only change required to the basic design, to allow the improved radiator assembly to be used on any size automobile engine, is to change the area of the core stack and the fluid carrying capacity of the radiator tubes.

In addition to the core assembly, the improved radiator assembly includes an inlet reservoir and an outlet reservoir that maintains the core in vertical compression. To minimize leaks and to increase structural integrity the reservoir tube sections are constructed of a one-piece cylindrical seamless tube in lieu of a typical square tank and header combination used in current radiator designs. The reservoirs are held in-place by a first support member and a second support member where both support members are of identical construction. The support members also incorporate brackets that are used to mount the radiator in the engine compartment. The only other elements of the improved radiator are a filler neck, and an outlet tube sealing plug. The filler neck is sized to fit into the fluid fill end of the inlet reservoir while the sealing plug is sized to fit into the bottom end of the outlet reservoir.

The simplified design of the improved radiator allows the following current radiator elements to be eliminated: top and bottom tanks; top and bottom header plates; inlet and outlet connection tubes; harness mounting straps; and multiple vertical or horizontal rows of radiator tubes.

To assemble the improved radiator assembly the radiator tubes and the ends of the first and second support members are pretinned with solder. The entire assembly is then placed in a standard radiator carrying rack and into a standard heat chamber where the soldering takes place in one operation. A detailed assembly procedure is presented infra.

In addition to providing a radiator design that uses fewer parts, is easier to assemble and install, and incorporates an advanced radiator core assembly, it is also an object of the invention to provide a radiator that:

- because of its inherent lighter weight is energy efficient,
- is smaller and uses less fluid than equivalent rated current radiator designs,
- has greater tube-to-fin contact than current radiator designs,
- greatly reduces the need for costly dies and metal forming machinery, and
- is suitable for large scale production for use by both original equipment manufacturers and secondary replacements.

BRIEF DESCRIPTION OF THE DRAWINGS

The details of the invention are described in connection with the accompanying drawings in which.

BEST MODE FOR CARRYING OUT THE INVENTION

Figure 1:
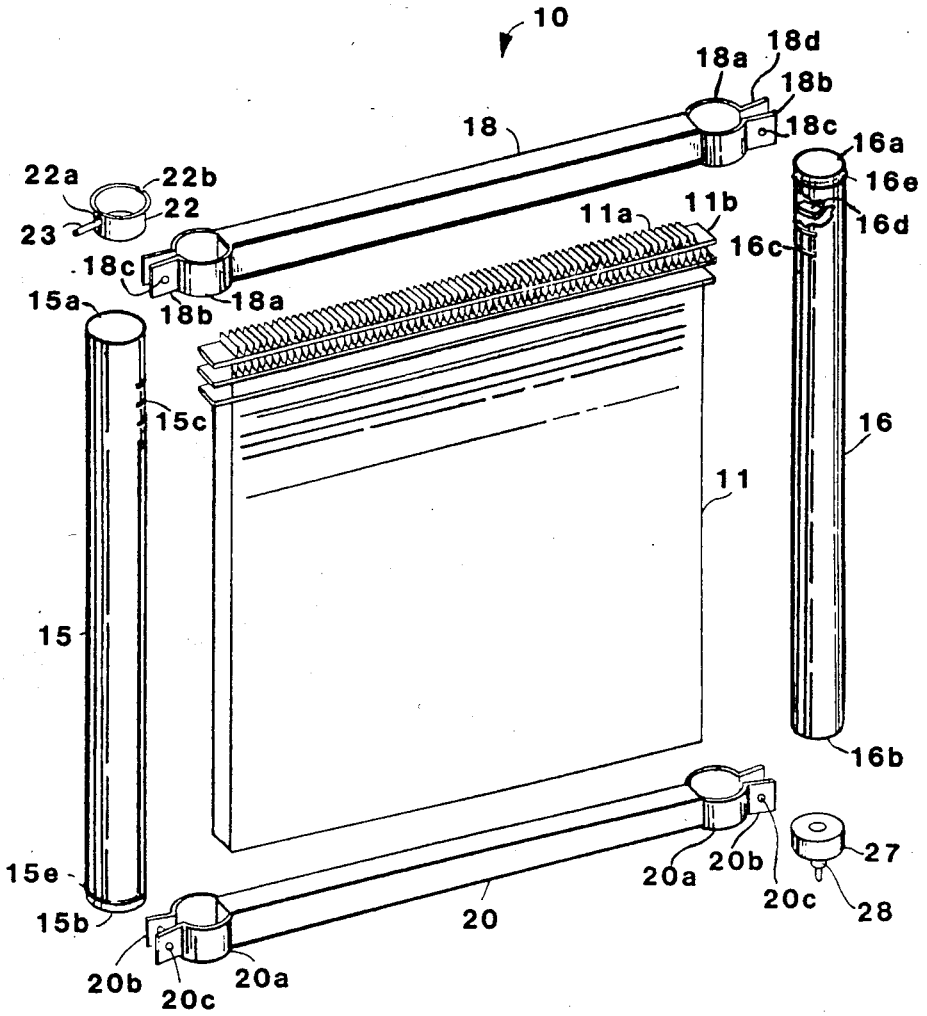
FIG. 1 is a perspective-exploded view of the improved radiator assembly.

The Improved Radiator Assembly 10 is described in terms of a basic crossflow radiator design as shown in FIG. 1. The basic design is modified by the configuration and area of the core assembly 11 which, in turn, is dependent upon the type, size and displacement of the engine that is to be cooled. The assembly 10 is comprised of seven major elements: the radiator core assembly 11, an inlet reservoir 16, an outlet reservoir 15, a first support member 18, a second support member 20, a filler neck 22, and an inlet tube sealing plug 27. The reservoirs 15 and 16 are identically constructed as are the support members 18 and 20.

The radiator core assembly 11 in a first configuration, is comprised of a single vertical-row plurality of horizontally and alternately stacked radiator fins 11*a* and radiator tubes 11*b* where the tubes are disposed between and abutt the fins. In a second configuration the radiator fins 11*a* and radiator tubes 11*b* are vertically and alternately stacked. With either configuration a core stack design is achieved where all the heat exchanging elements are located in a single frontal plane with the ram air being applied normal to the core stack plane.

Figure 2:
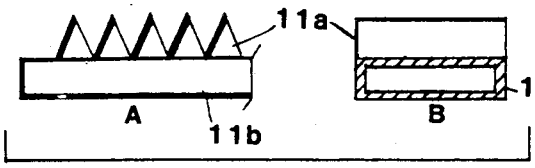
FIG. 2 is a side and front view of a typical section of a zig-zag radiator fin abutting a radiator tube.

The radiator fins 11*a*, as best shown in FIG. 2A and 2B are of a conventional zig-zag design. The fin density ranges from ten to fifteen fins per inch. However, in the preferred embodiment there are ten fins per inch (2.54 cm) with a fin height of 0.200 inches (0.508 cm) and a width selected to accommodate the width of the radiator tube.

The radiator tubes 11*b*, as best shown in FIGS. 2A and 2B are of a rectangular shape having a height of 0.100 inches (0.254 cm) and a width of either 0.525 inches (1.334 cm) or 0.750 inches (1.905 cm). The smaller size typically would be used with small engine blocks having displacements less than 250 cubic inches (4.0 liter while the larger size with engines having displacements greater than 250 cubic inches (4.0 liter). The combination of the radiator fins and radiator tubes is designed to provide a greater fin-to-tube contact than is presently available in conventional designs. Thus, providing a more effective heat-transfer surface area per unit volume.

The radiator core assembly 11 is held in place by the inlet reservoir 16 and the outlet reservoir 15 and the respective first support member 18 and second support member 20.

Figure 3:
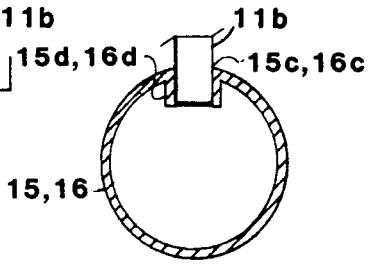
FIG. 3 is a cross-sectional view showing a radiator tube inserted into an aperture of an inlet reservoir or outlet reservoir.

The outlet reservoir 15 is comprised of a tube section that in the preferred embodiment is a one-piece seamless cylindrical tube made of material that resists corrosion such as copper or brass. The use of a seamless tube prevents fluid leaks that are prevalent in present design tanks having longitudinal joints that use a butt seam or a drop-down groove seam. The outlet reservoir is used to initially fill the assembly. The fluid fill end 15*a*, as shown in FIG. 1, is located at the top end of the reservoir 15 while the fluid outlet end 15*b* is on the bottom. On the inward side of the reservoir 15 are a plurality of apertures 15*c* having contiguous flanges 15*d*, as best shown in FIG. 3, extending inward from the top and bottom of the aperture 15*c* and where apertures extend in a single row from top to bottom of the tube section. The quantity of apertures 15*c* is equal to the quantity of radiator tubes 11*b* and the apertures are configured to fit tightly over the radiator tubes 11*b* as shown in FIG. 3.

The fluid fill end 15*a* is designed to accept internally a filler neck 22. The filler neck is comprised of a one-piece seamless cylindrical tube section also made of copper or brass having a fluid overflow bore 22*a* on one side to which is rigidly attached a fluid overflow tube 23. The upper section of the filler neck may have a keyed upper lip 22*b* to allow a corresponding keyed pressure cap to be attached.

The fluid outlet end 15*b* has a hose retaining lip 15*e* to allow a standard flexible hose 50 to be inserted and retained by a standard hose clamp 51. The other end of the hose 50 is similarly attached to an engine 52 which is normally the water pump inlet 53.

The inlet reservoir 16 is similarly constructed and configured as the outlet reservoir 15. The inlet reservoir 16 has on its top end a fluid inlet 16*a* into which the return heated fluid from the engine block is applied. The fluid inlet 16*a* also has a hose retaining lip 16*e* to allow a standard flexible hose 50 to be inserted and retained by a standard hose clamp 51. The other end of the hose 50 is similarly attached to the engine fluid outlet 54 on an engine 52. The bottom end 16*b* of the inlet reservoir 16 is designed to accept internally a pre-tinned inlet tube sealing plug 27 that is also made of copper or brass.

Figure 4:
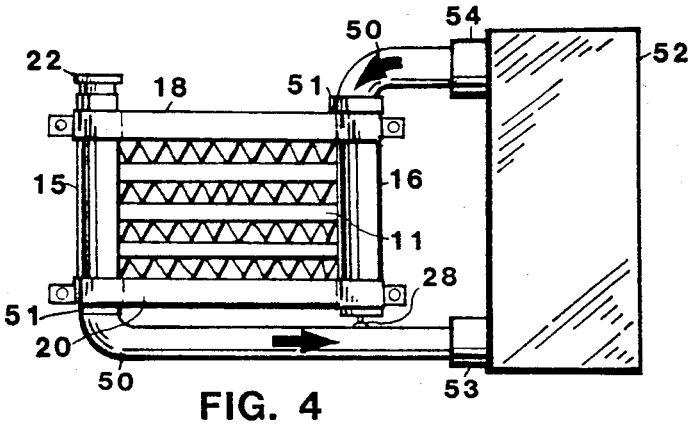
FIG. 4 is a schematic representation showing the fluid connections and fluid flow paths of the radiator with the engine elements.

A schematic representation showing the fluid flow paths and the fluid connections of the improved radiator assembly 10 with an engine is included as FIG. 4.

Figure 5:
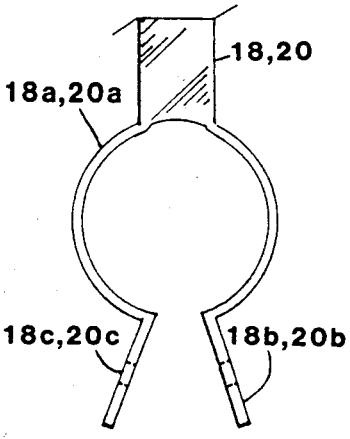
FIG. 5 is a top view of the circular clamp and circular clamp bracket.

The final two major elements to be described are the first support member 18 and second support member 20. Both of these members, as shown in FIG. 1, are used to provide additional structural integrity by holding in-place the inlet reservoir 16 and outlet reservoir 15. In the preferred embodiment, the members 18, 20 are constructed of metal box tubing having on each end a contiguous circular clamp 18*a*, 20*a* with a diameter suitable for clamping to the ends of the reservoirs 15, 16. The circular clamps comprise two half circles 18*a*, 20*a*, as best shown in FIG. 5, where each half circle has on its outward end a contiguous flat extension 18*b*, 20*b*. The flat extension has centrally located a mounting hole 18*c*, 20*c* that is in alignment with a corresponding hole 18*d*, 20*d* on the juxtaposed flat extension. The circular clamps 18*a* when joined, are sized to fit tightly over the fluid fill end 15*a* and fluid inlet end 16*a* of the respective outlet reservoir 15 and inlet reservoir 15. The circular clamps 20*a* when joined, are sized to fit tightly over the fluid outlet end 15*b* and the capped bottom end 16*b* of respective outlet reservoir 15 and inlet reservoir 16. The insides of the clamps 18*a*, 20*a* and brackets 18*b*, 20*c* are pretinned with solder which later melts to provide a permanent joint. The joined brackets function as a mounting bracket when installing the radiator assembly 10 in an engine compartment.

Figure 6:
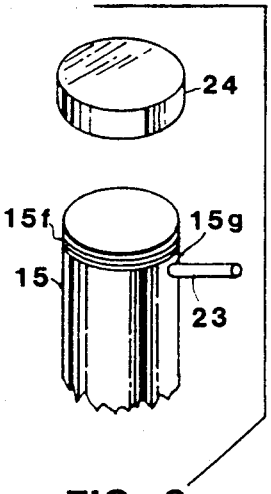
FIG. 6 is a perspective view showing a threaded section on the inlet reservoir and a corresponding threaded cap.

Modifications to the basic design of the improved radiator assembly 10 include the following:

The fluid fill end 15*a* of the outlet reservoir 15 as shown in FIG. 6, may be designed with a threaded section 15*f* to receive a corresponding threaded cap 24. A fluid overflow tube 23 would be attached to a bore 15*g* on the side of the outlet reservoir tube section.

Figure 7:
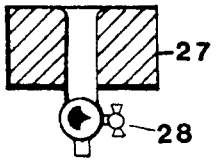
FIG. 7 is a cross-sectional view showing the outlet tube sealing plug incorporating a petcock.

The outlet sealing plug as shown in FIG. 7 may be designed to include a petcock 28 that is rigidly attached to the bottom of the sealing plug 27.

ASSEMBLY PROCEDURE

The Improved Radiator Assembly 10 is designed to be quickly and easily manufactured.

Pre-Assembly Operations

1. Clean all components to assure that they are grease free.
2. Pretin with solder the following components:

| COMPONENT | PRETINNED AREA |
|---|---|
| Radiator tube 11b | Entire tube |
| First support member 18 | Inside of circular clamp 18a and circular clamp bracket 18b |
| Second support member 20 | Inside of circular clamp 20a and circular clamp bracket 20b |

Assembly Operations

The Improved Radiator Assembly 10 is assembled in the following order. A standard radiator stacking fixture is used in the assembly.

1. The support member 20 is initially placed on the bottom of the stacking fixture.
2. A radiator fin 11*a* is next placed on top of the support member 20 followed by a fin 11*a*. The stacking sequence is continued until a predetermined total of fins and tubes have been stacked concluding with a fin 11*a*.
3. The support member 18 is placed on top of the final top fin 11*a*.
4. The loosely assembled stack is then compressed by an element of the stacking fixture. The amount of pressure applied is predetermined so that at the optimum pressure the radiator tubes 11*b* are properly spaced to allow insertion into the apertures 15*c* and 16*c* of the inlet and outlet reservoirs 15 and 16.
5. While the radiator core is under compression the inlet reservoir and outlet reservoir 16 and 15 are respectively aligned and inserted into the ends of the tubes 11*b*.
6. The first support member 18 and second support member 20 are next attached by spreading and slipping the open circular clamps 18*a*, 20*a* over their respective tube section. Each clamp is tightened by a self threading metal screw that is temporarily inserted through the bracket mounting holes 18*c*, 20*c*.
7. The assembled radiator is removed from the stacking fixture.
8. The filler neck 22, with a fluid overflow tube 23 attached to the bore 22*a*, is inserted into the fluid fill end 15*a* of the outlet reservoir 15 and the inlet tube sealing plug 27 is inserted into the bottom end 16*b* of the inlet reservoir 16.
9. The unsoldered radiator assembly 10 is then placed in a standard radiator carrying rack and into a standard heat chamber for a specified period of time to allow the pretinned solder to flow and hermetically and permanently bond all the interfacing components.
10. The soldered radiator assembly 10 is removed from the heat chamber and heat rack and the temporary self threading metal screws are removed from the circular clamp brackets 18*b*, 20*b*.
11. The improved radiator assembly is now ready for installation or stocking.

The design of the assembly 10 uses component parts that are particularly adapted to both an effective and simplified assembly operation and to mutual reinforcement after integration by soldering. This assembly concept, in turn, permits the integration of the entire structure in one soldering operation. Thus obviating any necessity of reheating which in the industry is widely accepted as necessary in radiator assembly.

Although the invention has been described in complete detail and pictorally shown in the accompanying drawings, it is not to be limited to such details since many changes and modifications may be made to the Improved Radiator Assembly 10 without departing from the spirit and scope thereof. Hence, the invention is described to cover any and all modifications and forms which may come within the language and scope of the claims.

What is claimed is:

1. An Improved Radiator Assembly for an engine comprising:

(a) a radiator core assembly comprising a single vertical-row plurality of horizontally and alternately stacked radiator fins and radiator tubes where said tubes are disposed between and abutt said fins, (b) an outlet reservoir comprising a one-piece cylindrical seamless tube section having a fluid fill end and a fluid outlet end, and also having on its inward side a plurality of apertures extending in a single row from top to bottom of said tube section, where said apertures have contiguous flanges extending inwardly from their upper and lower edges, and where the quantity of the apertures equals the quantity of said radiator tubes and ther apertures are configured to fit tightly over said radiator tubes, (c) an inlet reservoir comprising a one-piece cylindrical seamless tube section having a fluid inlet end and a plugged bottom end, and also having on its inward side a plurality of apertures extending from top to bottom of said tube section, where said apertures have contiguous flanges extending inwardly from their upper and lower edges, and where the quantity of the apertures equals the quantity of said radiator tubes and the apertures are configured to fit tightly over said radiator tubes, (d) a first support member having on each end a clamp configured to hold in-place the fluid fill end and the fluid inlet end of said outlet reservoir and said inlet reseroir respectively, (e) a second support member having on each end a clamp configured to hold in-place the fluid outlet end and the plugged bottom end of said outlet reservoir and said inlet reservoir respectively, (f) a filler neck comprising a one-piece seamless tube section having a fluid overflow bore on one side and a lower section sized to fit internally into the fluid fill end of said outlet reservoir, (g) a fluid overflow tube rigidly attached to the fluid overflow bore on said filler neck, (h) means to allow fluid from fluid outlet end on said outlet reservoir to be applied to an engine, (i) means to allow return fluid from an engine to be applied to the fluid inlet end on said inlet reservoir; and (j) means for permanently joining interfacing parts to integrate and provide structural integrity and hermiticity to said improved radiator assembly.

2. The assembly as specified in claim 1 wherein the means for permanently joining the interfacing parts is by initially pretinning one of the contact surfaces of the interfacing parts with a solder composition and subsequently applying heat to said assembly to allow solder to flow and subsequently solidify when said assembly is cooled.

* * * * *